US009617494B2

(12) United States Patent
Vander Neut et al.

(10) Patent No.: US 9,617,494 B2
(45) Date of Patent: Apr. 11, 2017

(54) METHOD FOR IMPROVING DEPOSIT CONTROL

(71) Applicants: Christopher J. Vander Neut, Mullica Hill, NJ (US); Kevin L. Crouthamel, Richboro, PA (US); John T. Fogarty, Swedesboro, NJ (US)

(72) Inventors: Christopher J. Vander Neut, Mullica Hill, NJ (US); Kevin L. Crouthamel, Richboro, PA (US); John T. Fogarty, Swedesboro, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 47 days.

(21) Appl. No.: 14/662,402

(22) Filed: Mar. 19, 2015

(65) Prior Publication Data

US 2015/0299602 A1 Oct. 22, 2015

Related U.S. Application Data

(60) Provisional application No. 61/981,239, filed on Apr. 18, 2014.

(51) Int. Cl.
*C10M 141/00* (2006.01)
*C10M 141/10* (2006.01)
(Continued)

(52) U.S. Cl.
CPC ..... *C10M 141/10* (2013.01); *C10M 129/10* (2013.01); *C10M 129/26* (2013.01);
(Continued)

(58) Field of Classification Search
CPC C10M 141/10; C10M 159/22; C10M 129/10; C10M 129/26; C10M 129/54;
(Continued)

(56) References Cited

U.S. PATENT DOCUMENTS 6,140,281 A * 10/2000 Blahey ..... C10M 129/02 508/398
6,162,770 A * 12/2000 Le Coent ..... C07C 51/15 508/460
2007/0117726 A1 5/2007 Cartwright

FOREIGN PATENT DOCUMENTS

EP 0933417 A1 8/1999
EP 1229101 A1 8/2002
(Continued)

OTHER PUBLICATIONS

The International Search Report and Written Opinion of PCT/US2015/021959 dated Jun. 16, 2015.

*Primary Examiner* — Cephia D Toomer
(74) *Attorney, Agent, or Firm* — Robert A. Migliorini

(57) ABSTRACT

A method for improving deposit control, while maintaining or improving demulsibility performance, in an engine lubricated with a lubricating oil by using as the lubricating oil a formulated oil that has a particular phenate/carboxylate detergent mixture present in a particular amount in the formulated oil. A lubricating engine oil having a composition including a lubricating oil base stock as a major component; and a phenate/carboxylate detergent mixture as a minor component. The lubricating oils of this disclosure are useful in marine crankcase systems, in particular, marine system oil applications for two-stroke marine diesel engines.

21 Claims, 3 Drawing Sheets

| | Comp. Ex. 1 | Comp. Ex. 2 | Comp. Ex. 3 | Comp. Ex. 4 | Comp. Ex. 5 | Comp. Ex. 6 |
|---|---|---|---|---|---|---|
| API Group I Base Oil | 96 | 96 | 96 | 95 | 96 | 96 |
| Detergent 1 | 2 | 2 | | | 1 | 1 |
| Detergent 2 | 1 | 1 | | | | |
| Detergent 3 | | | | | | 2 |
| Detergent 4 | | | 3 | 4 | 2 | |
| Detergent 5 | | | | | | |
| Detergent 6 | | | | | | |
| ZDDP 1 | 0.25 | | | | | |
| ZDDP 2 | | 0.4 | 0.4 | 0.4 | 0.4 | 0.4 |
| ZDDP 3 | | 0.2 | 0.2 | 0.2 | 0.2 | 0.2 |
| Other Additives | 0.4 | 0.4 | 0.3 | 0.3 | 0.4 | 0.4 |
| Zinc to Calcium Ratio | 0.103 | 0.245 | 0.210 | 0.157 | 0.199 | 0.263 |
| ASTM D2896 Total Base Number | 6 | 5.7 | 7.6 | 9.9 | 7.7 | 6 |
| Komatsu Hot Tube Test, 285°C | 5.5 | 3.5 | 0.5 | 8 | 2 | 3.5 |
| Komatsu Hot Tube Test, 300°C | 1 | 1 | | 4.5 | | |
| High Shear Demulsibility Test | | | | | | |
| Free Water, mL | 4 | 4.4 | 0 | 1 | 4.4 | 2.8 |
| Emulsion, mL | 0.2 | 0.1 | 100 | 4 | 0.2 | 2.2 |
| Oil Layer, mL | 93 | 92.6 | 0 | 94 | 95.4 | 95 |
| Water in Oil, wt% | 0.60 | 0.67 | 3.77 | 1.13 | 0.46 | 0.25 |

(51) Int. Cl.

| | |
|---|---|
| ***C10M 159/22*** | (2006.01) |
| ***C10M 129/10*** | (2006.01) |
| ***C10M 129/26*** | (2006.01) |
| ***C10M 129/54*** | (2006.01) |
| ***C10M 141/08*** | (2006.01) |
| ***C10M 163/00*** | (2006.01) |

(52) U.S. Cl.

CPC ..... *C10M 129/54* (2013.01); *C10M 141/08* (2013.01); *C10M 159/22* (2013.01); *C10M 163/00* (2013.01); *C10M 2203/1006* (2013.01); *C10M 2203/1025* (2013.01); *C10M 2207/027* (2013.01); *C10M 2207/028* (2013.01); *C10M 2207/10* (2013.01); *C10M 2207/144* (2013.01); *C10M 2207/262* (2013.01); *C10M 2215/064* (2013.01); *C10M 2219/044* (2013.01); *C10M 2219/087* (2013.01); *C10M 2223/045* (2013.01); *C10N 2210/02* (2013.01); *C10N 2230/04* (2013.01); *C10N 2230/08* (2013.01); *C10N 2230/24* (2013.01); *C10N 2240/10* (2013.01); *C10N 2240/102* (2013.01)

(58) Field of Classification Search

CPC .. C10M 2203/1006; C10M 2203/1025; C10M 2207/027; C10M 2207/028; C10M 2207/10; C10M 2207/144; C10M 2207/262; C10M 2223/045; C10M 141/08; C10M 163/00; C10M 2215/064; C10M 2219/044; C10M 2219/087; C10N 2210/02; C10N 2230/04; C10N 2240/10; C10N 2240/102; C10N 2230/08; C10N 2230/24

See application file for complete search history.

(56) References Cited

FOREIGN PATENT DOCUMENTS

| | | | |
|---|---|---|---|
| EP | 1728849 | A1 | 6/2006 |
| IN | 185637 | A | 3/2001 |
| WO | 2011094562 | A1 | 8/2011 |

* cited by examiner

Fig. 1

| | Comp. Ex. 1 | Comp. Ex. 2 | Comp. Ex. 3 | Comp. Ex. 4 | Comp. Ex. 5 | Comp. Ex. 6 |
|---|---|---|---|---|---|---|
| API Group I Base Oil | 96 | 96 | 96 | 95 | 96 | 96 |
| Detergent 1 | 2 | 2 | | | 1 | 1 |
| Detergent 2 | 1 | 1 | | | | |
| Detergent 3 | | | | | | 2 |
| Detergent 4 | | | 3 | 4 | 2 | |
| Detergent 5 | | | | | | |
| Detergent 6 | | | | | | |
| ZDDP 1 | 0.25 | | | | | |
| ZDDP 2 | | 0.4 | 0.4 | 0.4 | 0.4 | 0.4 |
| ZDDP 3 | | 0.2 | 0.2 | 0.2 | 0.2 | 0.2 |
| Other Additives | 0.4 | 0.4 | 0.3 | 0.3 | 0.4 | 0.4 |
| Zinc to Calcium Ratio | 0.103 | 0.245 | 0.210 | 0.157 | 0.199 | 0.263 |
| ASTM D2896 Total Base Number | 6 | 5.7 | 7.6 | 9.9 | 7.7 | 6 |
| Komatsu Hot Tube Test, 285°C | 5.5 | 3.5 | 0.5 | 8 | 2 | 3.5 |
| Komatsu Hot Tube Test, 300°C | 1 | 1 | | 4.5 | | |
| High Shear Demulsibility Test | | | | | | |
| Free Water, mL | 4 | 4.4 | 0 | 1 | 4.4 | 2.8 |
| Emulsion, mL | 0.2 | 0.1 | 100 | 4 | 0.2 | 2.2 |
| Oil Layer, mL | 93 | 92.6 | 0 | 94 | 95.4 | 95 |
| Water in Oil, wt% | 0.60 | 0.67 | 3.77 | 1.13 | 0.46 | 0.25 |

Fig. 1 (Cont.)

| | Comp. Ex. 7 | Comp. Ex. 8 | Comp. Ex. 9 | Comp. Ex. 10 | Comp. Ex. 11 |
|---|---|---|---|---|---|
| API Group I Base Oil | 95 | 94 | 95 | 96 | 95 |
| Detergent 1 | 1 | | | | |
| Detergent 2 | | | | | |
| Detergent 3 | 3 | | | | |
| Detergent 4 | | 2 | 2 | | |
| Detergent 5 | | | | | 4 |
| Detergent 6 | | 3 | 2 | 3 | |
| ZDDP 1 | | | | | |
| ZDDP 2 | 0.4 | 0.4 | 0.4 | 0.4 | 0.4 |
| ZDDP 3 | 0.2 | 0.2 | 0.2 | 0.2 | 0.2 |
| Other Additives | 0.4 | 0.3 | 0.3 | 0.3 | 0.3 |
| | | | | | |
| Zinc to Calcium Ratio | 0.209 | 0.221 | 0.245 | 0.739 | 0.172 |
| ASTM D2896 Total Base Number | 7.4 | 7.2 | 6.6 | 2.9 | 9.1 |
| Komatsu Hot Tube Test, 285°C | 4.5 | 6.5 | 2 | 4.5 | 5.5 |
| Komatsu Hot Tube Test, 300°C | | 1 | | 2 | 3 |
| High Shear Demulsibility Test | | | | | |
| Free Water, mL | 0 | 4.2 | 4.5 | 4.4 | 0 |
| Emulsion, mL | 6 | 0 | 0 | 0 | 4.6 |
| Oil Layer, mL | 92 | 91.8 | 95.5 | 91.6 | 90.4 |
| Water in Oil, wt% | 2.74 | 0.26 | 0.40 | 0.20 | 0.79 |

Fig. 1 (Cont.)

| | Comp. Ex. 12 | Ex. 1 | Ex. 2 | Ex. 3 | Ex. 4 |
|---|---|---|---|---|---|
| API Group I Base Oil | 95 | 96 | 95 | 96 | 96 |
| Detergent 1 | 1.5 | 1 | 1 | 1.5 | 1 |
| Detergent 2 | | | | | |
| Detergent 3 | | | | | 0.5 |
| Detergent 4 | | 2.5 | 3 | 2 | 2 |
| Detergent 5 | | | | | |
| Detergent 6 | 3 | | | | |
| ZDDP 1 | | | | | |
| ZDDP 2 | 0.4 | 0.4 | 0.4 | 0.4 | 0.4 |
| ZDDP 3 | 0.2 | 0.2 | 0.2 | 0.2 | 0.2 |
| Other Additives | 0.3 | 0.4 | 0.4 | 0.4 | 0.4 |
| | | | | | |
| Zinc to Calcium Ratio | 0.243 | 0.172 | 0.151 | 0.168 | 0.181 |
| ASTM D2896 Total Base Number | 6.3 | 8.8 | 10 | 9 | 8.4 |
| Komatsu Hot Tube Test, 285°C | 4 | 6 | 6 | 6 | 6 |
| Komatsu Hot Tube Test, 300°C | 1 | 3.5 | 3.5 | 3 | 3.5 |
| High Shear Demulsibility Test | | | | | |
| Free Water, mL | 4.2 | 4 | 4.4 | 4 | 4.4 |
| Emulsion, mL | 0.2 | 0.4 | 0.2 | 0.4 | 0.2 |
| Oil Layer, mL | 95.6 | 95.6 | 95.4 | 95.6 | 93.4 |
| Water in Oil, wt% | 0.40 | 0.71 | 0.66 | 0.37 | 0.47 |

METHOD FOR IMPROVING DEPOSIT CONTROL

CROSS-REFERENCE TO RELATED APPLICATIONS

This application claims priority to U.S. Provisional Application Ser. No. 61/981,239 filed Apr. 18, 2014, which is herein incorporated by reference in its entirety.

FIELD

This disclosure relates to a method for improving deposit control, while maintaining or improving demulsibility performance, in an engine lubricated with a lubricating oil by using as the lubricating oil a formulated oil that has a particular phenate/carboxylate detergent mixture present in a particular amount in the formulated oil. The lubricating oils of this disclosure are useful in crankcases used in marine applications.

BACKGROUND

Engine designers are continually striving for more efficient engines that provide a better value to customers and last for a longer time period. As such, engine designs are becoming more severe and the need for improved deposit control is on the forefront.

In addition to cleanliness, marine diesel engines have requirements for superior demulsibility to shed water from the lubricant. This allows the oil and the equipment to last longer by preventing poor lubricity, corrosion, and rust.

In particular, large 2-stroke marine diesel engines include an engine, a crankcase, and a propeller. Marine system oils are commonly used to lubricate the crankcase of marine engines. Marine system oils tend to lose certain performance characteristics and benefits over time in marine environments. Marine system oils are particularly susceptible to performance deterioration due to the introduction of water into the marine drivetrain. Normally water separates from oil, and in an engine or drivetrain, should this not occur, the water will induce corrosion and lead to the hydrolysis of certain lubricant additives leading to acidic byproducts that attack the engine or drivetrain further.

Current system oils provide Komatsu Hot Tube deposit results (from 10=best to 0=worst) in the range of 5.5 down to 1.5 at 285° C. and 1.5 down to 0 at 300° C. Improved deposit control can be achieved by increasing the treat rate of detergent additives, but typically at the cost of demulsibility performance. Current technologies cause demulsibility problems when the detergent additive treat rate is increased.

A major challenge in engine oil formulation is simultaneously achieving improved deposit control, while also achieving maintained or improved demulsibility performance.

Despite the advances in lubricant oil formulation technology, there exists a need for an engine oil lubricant that effectively improves deposit control, while also achieving improved demulsibility performance.

SUMMARY

This disclosure relates in part to a method for improving deposit control, while maintaining or improving demulsibility performance, in an engine lubricated with a lubricating oil by using as the lubricating oil a formulated oil that has a particular phenate/carboxylate detergent mixture present in a particular amount in the formulated oil. The lubricating oils of this disclosure are useful in marine crankcase systems, in particular, marine system oil applications including the gears of two-cycle or four-cycle marine engines.

This disclosure also relates in part to a method for improving deposit control, while maintaining or improving demulsibility performance, in an engine lubricated with a lubricating oil by using as the lubricating oil a formulated oil. The formulated oil has a composition comprising a lubricating oil base stock as a major component; and a detergent mixture comprising a first detergent, and at least one other detergent different from the first detergent, as a minor component. The first detergent and the at least one other detergent are selected from the group consisting of a phenate compound, a carboxylate compound, and mixtures thereof. The phenate compound, carboxylate compound, and mixtures thereof, and the amount of the phenate compound, carboxylate compound, and mixtures thereof in the lubricating oil, are sufficient for the lubricating oil to exhibit improved deposit control, while demulsibility performance is maintained or improved, as compared to deposit control and demulsibility performance achieved using a lubricating oil containing a minor component other than the phenate compound, carboxylate compound, and mixtures thereof, and in an amount other than the amount of the phenate compound, carboxylate compound, and mixtures thereof in the lubricating oil.

This disclosure further relates in part to a lubricating engine oil having a composition comprising a lubricating oil base stock as a major component; and a detergent mixture comprising a first detergent, and at least one other detergent different from the first detergent, as a minor component. The first detergent and the at least one other detergent are selected from the group consisting of a phenate compound, a carboxylate compound, and mixtures thereof. The phenate compound, carboxylate compound, and mixtures thereof, and the amount of the phenate compound, carboxylate compound, and mixtures thereof in the lubricating oil, are sufficient for the lubricating oil to exhibit improved deposit control, while demulsibility performance is maintained or improved, as compared to deposit control and demulsibility performance achieved using a lubricating oil containing a minor component other than the phenate compound, carboxylate compound, and mixtures thereof, and in an amount other than the amount of the phenate compound, carboxylate compound, and mixtures thereof in the lubricating oil.

It has been surprisingly found that, in accordance with this disclosure, improvements in deposit control can be attained, while maintaining or improving demulsibility performance, in an engine lubricated with a lubricating oil by using as the lubricating oil a formulated oil that has a particular phenate/carboxylate detergent mixture present in a particular amount (e.g., from about 0.5 to about 2.5 weight percent of the phenate compound and from about 1.0 to about 4.0 weight percent of the carboxylate compound, based on the total weight of the lubricating oil) in the lubricating oil. The lubricating oils of this disclosure are suitable for use in marine system oil applications where the oil is used to lubricate engine bearings, gears, pumps, and/or hydraulics in two-cycle marine engines.

Other objects and advantages of the present disclosure will become apparent from the detailed description that follows.

BRIEF DESCRIPTION OF THE DRAWINGS

FIG. 1 shows the formulation details in weight percent, based on the total weight percent of the formulation, of various lubricating oil formulations. FIG. 1 also shows the results of testing conducted for these formulations. The testing included deposit measurements of the formulations as measured by Komatsu Hot Tube Test, and demulsibility measurements of the formulations as measured by High Shear Demulsibility testing. Total base number (TBN) of the formulations was also determined by ASTM D2896. A ratio of zinc to calcium in the finished blend is shown in FIG. 1.

DETAILED DESCRIPTION

All numerical values within the detailed description and the claims herein are modified by "about" or "approximately" the indicated value, and take into account experimental error and variations that would be expected by a person having ordinary skill in the art.

It has now been found that improved deposit control can be attained, while maintaining or improving demulsibility performance, in an engine lubricated with a lubricating oil by using as the lubricating oil a formulated oil that has a particular detergent mixture present in a particular amount in the formulated oil. The formulated oil preferably comprises a lubricating oil base stock as a major component, and a particular phenate/carboxylate detergent mixture as minor component. The lubricating oils of this disclosure are particularly advantageous as marine crankcase systems.

The lubricating oils of this disclosure provide excellent engine protection including deposit control, while maintaining or improving demulsibility performance, in an engine lubricated with a lubricating oil. This benefit has been demonstrated for the lubricating oils of this disclosure in deposit measurements of the formulations as measured by Komatsu Hot Tube Test where oil is heated to 285° C. or 300° C. and passed through a glass tube, then rated for deposits from 0 (poor) to 10 (clean), and demulsibility measurements of the formulations as measured by High Shear Demulsibility testing, where oil is mixed with a minor amount of water in a high shear blending environment to generate an emulsion, then centrifuged and rated for emulsion layer, free water, water in oil, oil layer description and water.

In deposit measurements of the formulations as measured by Komatsu Hot Tube Test, this test utilizes glass tubes inserted into an aluminum block. The block is heated up to the test temperature, either 285° C. or 300° C. in this disclosure. The test sample is pumped through the glass tube for 16 hours at a flow rate of 0.31 mL/hr, along with an air flow of 10 mL/min. At the end of the test, tubes are rinsed and rated visually on a scale of 1 to 10. A 0 rating indicates a black tube and a 10 indicates a clean tube. Deposit control is improved as compared to deposit control of a lubricating oil containing a minor component other than the phenate/carboxylate detergent mixture in the lubricating oils of this disclosure, and in an amount other than the amount of the phenate/carboxylate detergent mixture in the lubricating oils of this disclosure.

Demulsibility measurements of the lubricating oils of this disclosure were measured by High Shear Demulsibility Test. This method is conducted by taking a sample of oil and adding 5% water to a graduated container, then mixing at over 10,000 RPM for less than 2 minutes. The mixture is then separated by centrifuge at over 500 G's for 2 hours. Water, oil, and emulsion layers are measured in mL visually after the test. Water in oil can be determined by Karl Fischer method, ASTM E203. A lower result for emulsion, preferably below 1 mL, and lower water in oil, preferably below 1 wt % is desirable, while a higher result for free water, preferably above 3.8 mL, is preferred. The demulsibility performance is unexpectedly maintained or improved as compared to the demulsibility performance of a lubricating oil containing a minor component other than the phenate/carboxylate detergent mixture in the lubricating oils of this disclosure, and in an amount other than the amount of the phenate/carboxylate detergent mixture in the lubricating oils of this disclosure.

In an embodiment, the lubricating oils of this disclosure useful for marine crankcase systems also unexpectedly provide improved FZG load carrying capability without sacrificing demulsibility performance. Historically, the ZDDP antiwear additive used to improve FZG load carrying performance has shown poorer demulsibility performance with increasing treat rates and typical use is in the 0.2-0.4 weight percent range of ZDDP additive in the oil. By adjusting the ZDDP alcohol chain length used in the lubricating oil formulations, optimum demulsibility performance can be obtained, even at higher treat rates. For longer alcohol chains such as primary C8 or secondary C6 types or primary C5 types, the treat rate is in the 0.1 to about 0.8 weight percent range, preferably from about 0.2 to about 0.8 weight percent, and more preferably from about 0.2 to about 0.6 weight percent, additive in the oil. Shorter chains such as secondary i-C3 or 2-C4 types show good demulsibility performance at about 0.3 to about about 0.8 weight percent range, preferably from about 0.4 to about 0.8 weight percent, and more preferably from about 0.4 to about 0.7 weight percent, additive in the oil. Longer chain ZDDP additives are better for demulsibility performance and shorter chain ZDDP additives are better for FZG performance. These two chain lengths can surprisingly be balanced, thereby achieving unexpectedly superior performance in both FZG load carrying capability and demulsibility performance.

As used herein, the term "marine" is intended to encompass any body of water including saltwater and/or fresh water environments.

Lubricating Oil Base Stocks

A wide range of lubricating base oils is known in the art. Lubricating base oils that are useful in the present disclosure are both natural oils, and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad base oil stock categories developed and defined by the American Petroleum Institute (API Publication 1509; www.API.org) to create guidelines for lubricant base oils. Group I base stocks have a viscosity index of between about 80 to 120 and contain greater than about 0.03% sulfur and/or less than about 90% saturates. Group II base stocks have a viscosity index of between about 80 to 120, and contain less than or equal to about 0.03% sulfur and greater than or equal to about 90% saturates. Group III stocks have a viscosity index greater than about 120 and contain less than or equal to about 0.03% sulfur and greater than about 90% saturates. Group IV includes polyalphaolefins (PAO). Group V base stock includes base stocks not included in Groups I-IV. The table below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Includes polyalphaolefins (PAO) products | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked basestocks, and synthetic oils such as polyalphaolefins, alkyl aromatics and synthetic esters are also well known basestock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from about 250 to about 5,000, although PAO's may be made in viscosities up to about 1000 cSt (100° C.). The PAOs are typically comprised of relatively low molecular weight hydrogenated polymers or oligomers of alphaolefins which include, but are not limited to, $C_2$ to about $C_{32}$ alphaolefins with the $C_8$ to about $C_{16}$ alphaolefins, such as 1-hexene, 1-octene, 1-decene, 1-dodecene and the like, being preferred. The preferred polyalphaolefins are poly-1-hexene, poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity base stocks of acceptably low volatility. Depending on the viscosity grade and the starting oligomer, the PAOs may be predominantly trimers and tetramers of the starting olefins, with minor amounts of the higher oligomers, having a viscosity range of 1.5 to 1000 cSt or more. PAO fluids of particular use may include 3.0 cSt, 3.4 cSt, 3.6 cSt, 4 cSt, 6 cSt, 8 cSt, 10 cSt, 40 cSt, 100 cSt, and/or 150 cSt and combinations thereof.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. Nos. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

Other useful lubricant oil base stocks include wax isomerate base stocks and base oils, comprising hydroisomerized waxy stocks (e.g. waxy stocks such as gas oils, slack waxes, fuels hydrocracker bottoms, etc.), hydroisomerized Fischer-Tropsch waxes, Gas-to-Liquids (GTL) base stocks and base oils, and other wax isomerate hydroisomerized base stocks and base oils, or mixtures thereof Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. For example, one useful catalyst is ZSM-48 as described in U.S. Pat. No. 5,075,269, the disclosure of which is incorporated herein by reference in its entirety. Processes for making hydrocracked/hydroisomerized distillates and hydrocracked/hydroisomerized waxes are described, for example, in U.S. Pat. Nos. 2,817,693; 4,975,177; 4,921,594 and 4,897,178 as well as in British Patent Nos. 1,429,494; 1,350,257; 1,440,230 and 1,390,359. Each of the aforementioned patents is incorporated herein in their entirety. Particularly favorable processes are described in European Patent Application Nos. 464546 and 464547, also incorporated herein by reference. Processes using Fischer-Tropsch wax feeds are described in U.S. Pat. Nos. 4,594,172 and 4,943,672, the disclosures of which are incorporated herein by reference in their entirety.

Gas-to-Liquids (GTL) base oils, Fischer-Tropsch wax derived base oils, and other wax-derived hydroisomerized (wax isomerate) base oils may be advantageously used in the instant disclosure, and may have useful kinematic viscosities at 100° C. of about 3 cSt to about 50 cSt, preferably about 3 cSt to about 30 cSt, more preferably about 3.5 cSt to about 25 cSt, as exemplified by GTL 4 with kinematic viscosity of about 4.0 cSt at 100° C. and a viscosity index of about 141. These Gas-to-Liquids (GTL) base oils, Fischer-Tropsch wax derived base oils, and other wax-derived hydroisomerized base oils may have useful pour points of about −20° C. or lower, and under some conditions may have advantageous pour points of about −25° C. or lower, with useful pour points of about −30° C. to about −40° C. or lower. Useful compositions of Gas-to-Liquids (GTL) base oils, Fischer-Tropsch wax derived base oils, and wax-derived hydroisomerized base oils are recited in U.S. Pat. Nos. 6,080,301; 6,090,989, and 6,165,949 for example, and are incorporated herein in their entirety by reference.

The hydrocarbyl aromatics can be used as base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from about $C_6$ up to about $C_{60}$ with a range of about $C_8$ to about $C_{20}$ often being preferred. A mixture of hydrocarbyl groups is often preferred, and up to about three such substituents may be present. The hydrocarbyl group can optionally contain sulfur, oxygen, and/or nitrogen containing substituents. The aromatic group can also be derived from natural (petroleum) sources, provided at least about 5% of the molecule is comprised of an above-type aromatic moiety. Viscosities at 100° C. of approximately 3 cSt to about 50 cSt are preferred, with viscosities of approximately 3.4 cSt to about 20 cSt often being more preferred for the hydrocarbyl aromatic component. An alkyl naphthalene where the alkyl group is primarily comprised of 1-hexadecene may be used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be about 2% to about 25%, preferably about 4% to about 20%, and more preferably about 4% to about 15%, depending on the application.

Alkylated aromatics such as the hydrocarbyl aromatics of the present disclosure may be produced by well-known Friedel-Crafts alkylation of aromatic compounds. See Friedel-Crafts and Related Reactions, Olah, G. A. (ed.), Interscience Publishers, New York, 1963. For example, an aromatic compound, such as benzene or naphthalene, is alkylated by an olefin, alkyl halide or alcohol in the presence of a Friedel-Crafts catalyst. See Friedel-Crafts and Related Reactions, Vol. 2, part 1, chapters 14, 17, and 18, See Olah, G. A. (ed.), Inter-science Publishers, New York, 1964. Many homogeneous or heterogeneous, solid catalysts are known to one skilled in the art. The choice of catalyst depends on the reactivity of the starting materials and product quality requirements. For example, strong acids such as $AlCl_3$, $BF_3$, or HF may be used. In some cases, milder catalysts such as $FeCl_3$ or $SnCl_4$ are preferred. Newer alkylation technology uses zeolites or solid super acids.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least about 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from about 5 to about 100 carbon atoms. These esters are widely available commercially, for example, the Mobil P-41 and P-51 esters of ExxonMobil Chemical Company.

Also useful are esters derived from renewable material such as coconut, palm, rapeseed, soy, sunflower and the like. These esters may be monoesters, di-esters, polyol esters, complex esters, or mixtures thereof. These esters are widely available commercially, for example, the Mobil P-51 ester of ExxonMobil Chemical Company.

Engine oil formulations containing renewable esters are included in this disclosure. For such formulations, the renewable content of the ester is typically greater than about 70 weight percent, preferably more than about 80 weight percent and most preferably more than about 90 weight percent.

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from about 2 $mm^2/s$ to about 50 $mm^2/s$ (ASTM D445). They are further characterized typically as having pour points of −5° C. to about −40° C. or lower (ASTM D97). They are also characterized typically as having viscosity indices of about 80 to about 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) and hydrodewaxed, or hydroisomerized/cat (and/or solvent) dewaxed base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low sulfur, sulfated ash, and phosphorus (low SAP) products.

Base oils for use in the formulated lubricating oils useful in the present disclosure are any of the variety of oils corresponding to API Group I, Group II, Group III, Group IV, and Group V oils and mixtures thereof, preferably API Group I, II, Group III, and Group IV oils and mixtures thereof, more preferably the Group I to Group III base oils due to their exceptional antioxidation and solubility features. In regard to the Group I and Group II stocks, it is preferred that the stocks be in the higher quality range associated with that stock, i.e. a stock having a viscosity index in the range 95<VI<120.

The base oil constitutes the major component of the engine oil lubricant composition of the present disclosure and typically is present in an amount ranging from about 50 to about 99 weight percent, preferably from about 70 to about 98 weight percent, and more preferably from about 85 to about 98 weight percent, based on the total weight of the composition. The base oil may be selected from any of the synthetic or natural oils typically used as crankcase lubricating oils for spark-ignited and compression-ignited engines. The base oil conveniently has a kinematic viscosity, according to ASTM standards, of about 2.5 cSt to about 12 cSt (or $mm^2/s$) at 100° C. and preferably of about 2.5 cSt to about 9 cSt (or $mm^2/s$) at 100° C. Mixtures of synthetic and natural base oils may be used if desired.

Detergent Mixtures

Illustrative detergents useful in this disclosure include, for example, alkali metal detergents, alkaline earth metal detergents, or mixtures of one or more alkali metal detergents and one or more alkaline earth metal detergents. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

The detergent mixtures useful in the lubricating oils of this disclosure comprise a first detergent, and at least one other detergent different from said first detergent. The first detergent and the at least one other detergent are selected from the group consisting of a phenate compound, a carboxylate compound, and mixtures thereof. The phenate compound, carboxylate compound, and mixtures thereof, and the amount of the phenate compound, carboxylate compound, and mixtures thereof in the lubricating oil, are sufficient for the lubricating oil to exhibit improved deposit control, while demulsibility performance is maintained or improved, as compared to deposit control and demulsibility performance achieved using a lubricating oil containing a minor component other than the phenate compound, carboxylate compound, and mixtures thereof, and in an amount other than the amount of the phenate compound, carboxylate compound, and mixtures thereof in the lubricating oil.

Alkaline earth phenates are a useful class of detergents. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include of the alkyl phenol or the sulfurized alkylphenol straight chain or branched $C_1$-$C_{30}$ alkyl groups, preferably, $C_4$-$C_{20}$ or mixtures thereof. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched and can be used from 0.5 to 6 weight percent. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Preferred phenate compounds include, for example, an overbased phenate compound, a sulfurized/carbonated calcium phenate compound, and mixtures thereof.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level.

Detergents made from salicylic acid are one preferred class of detergents derived from carboxylic acids. Useful salicylates include long chain alkyl salicylates. One useful family of compositions is of the formula

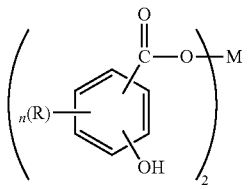

where R is an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Preferred carboxylate compounds comprise a mixture of an alkylphenol, noncarbonated calcium alkylphenate and noncarbonated calcium monosalicylate(carboxylate); a carbonated calcium monosalicylate(carboxylate); and mixtures thereof.

Salts that contain a substantially stoichiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased and these can be used individually or in combination with one another.

Alkaline earth metal phosphates may also be used as detergents and are known in the art.

Detergents may be simple detergents or what is known as hybrid or complex detergents. The latter detergents can provide the properties of two detergents without the need to blend separate materials. See U.S. Pat. No. 6,034,039.

Preferred detergents include calcium phenates, calcium salicylates, magnesium phenates, magnesium salicylates and other related components (including borated detergents), and mixtures thereof. Preferred detergents include phenate/carboxylate mixtures, where mixtures are either individual detergents or complex detergents or can be of different TBN or different metals.

In particular, the detergent mixtures useful in the lubricating oils of this disclosure contain a first detergent in a concentration in the lubricating oils ranging from about 1.0 to about 10.0 weight percent, preferably about 1.5 to 10.0 weight percent, more preferably from about 1.5 weight percent to about 8.0 weight percent, still more preferably from about 1.5 weight percent to about 6.0 weight percent, even more preferably from about 1.5 weight percent to about 5.0 weight percent, even still more preferably from about 1.5 weight percent to about 4.0 weight percent, based on the total weight of the lubricating oil; and at least one other detergent different from said first detergent which can range from about 0.5 to about 5.0 weight percent, preferably from about 0.5 to about 4.0 weight percent, more preferably from about 0.5 to about 3.0 weight percent, still more preferably from about 1.0 to about 3.0 weight percent, even more preferably from about 1.0 to about 2.5 weight percent, based on the total weight of the lubricating oil.

The detergent concentration in the lubricating oils of this disclosure can range from about 1 to about 10.0 weight percent, preferably about 2.0 to about 10 weight percent, more preferably from about 2.0 weight percent to about 8.0 weight percent, still more preferably from about 2.0 weight percent to about 6.0 weight percent, even more preferably from about 2.0 weight percent to about 5.0 weight percent, even still more preferably from about 2.0 weight percent to about 4.0 weight percent, based on the total weight of the lubricating oil. In the lubricating oils of this disclosure, the amount of phenate compound preferably can range from about 0.5 to about 3.5 weight percent, preferably from about 0.5 to about 3.0 weight percent, more preferably from about 0.5 to about 2.5 weight percent, still more preferably from about 0.5 to about 2.0 weight percent, even more preferably from about 0.5 to about 1.5 weight percent, based on the total weight of the lubricating oil. In the lubricating oils of this disclosure, the amount of carboxylate can range from about 0.5 to about 5.0 weight percent, preferably from about 0.5 to about 4.0 weight percent, more preferably from about 1.0 to about 3.0 weight percent, still more preferably from about 1.5 to about 3.0 weight percent, even more preferably from about 1.5 to 2.5 weight percent, based on the total weight of the lubricating oil.

As used herein, the detergent concentrations are given on an "as delivered" basis. Typically, the active detergent is delivered with a process oil. The "as delivered" detergent typically contains from about 20 weight percent to about 80 weight percent, or from about 40 weight percent to about 60 weight percent, of active detergent in the "as delivered" detergent product.

Antiwear Additive

A metal alkylthiophosphate and more particularly a metal dialkyl dithio phosphate in which the metal constituent is zinc, or zinc dialkyl dithio phosphate (ZDDP) is a useful component of the lubricating oils of this disclosure. ZDDP can be derived from primary alcohols, secondary alcohols or mixtures thereof. The preferred ZDDP compounds generally are represented by the formula $$Zn[SP(S)(OR^1)(OR^2)]_2$$

wherein $R^1$ and $R^2$ are independently primary or secondary $C_1$ to $C_8$ alkyl groups. The $R^1$ and $R^2$ substituents can independently be $C_1$-$C_{18}$ alkyl groups, preferably $C_2$-$C_{12}$ alkyl groups. These alkyl groups may be straight chain or branched. Alkyl aryl groups may also be used.

Preferable zinc dithiophosphates which are commercially available include secondary zinc dithiophosphates such as those available from for example, The Lubrizol Corporation under the trade designations "LZ 677A", "LZ 1095" and "LZ 1371", from for example Chevron Oronite under the trade designation "OLOA 262" and from for example Afton Chemical under the trade designation "HITEC 7169".

Preferably, the primary or secondary alkyl groups of the zinc dialkyl dithiophosphate compound are derived from an alcohol selected from 2-propanol, 1-butanol, 1-isobutanol, 2-butanol, 1-pentanol, 3-methyl-1-butanol, 2-pentanol, 3-pentanol, 3-methyl-2-butanol, 1-hexanol, 4-methyl-1-pentanol, 4-methyl-2-pentanol, 2-ethyl-1-hexanol, 5-methyl-2-hexanol, or other iso-C8 alcohols or longer, or mixtures thereof.

The $R^1$ and $R^2$ primary or secondary alkyl groups of the zinc dialkyl dithiophosphate compound, and the amount of the zinc dialkyl dithiophosphate compound having the $R^1$ and $R^2$ primary or secondary alkyl groups in the lubricating oil, are sufficient for the lubricating oil to exhibit improved antiwear performance and demulsibility performance as compared to antiwear performance and demulsibility performance achieved using a lubricating oil containing a minor component other than the zinc dialkyl dithiophosphate compound having the $R^1$ and $R^2$ primary or secondary alkyl groups, and in an amount other than the amount of the zinc dialkyl dithiophosphate compound having the $R^1$ and $R^2$ primary or secondary alkyl groups.

In general, the ZDDP can be used in amounts of from about 0.2 weight percent to about 1.2 weight percent, preferably from about 0.2 weight percent to about 1.0 weight percent, more preferably from about 0.2 weight percent to about 0.8 weight percent, still more preferably from about 0.2 weight percent to about 0.6 weight percent, even more preferably from about 0.4 weight percent to about 0.6 weight percent, based on the total weight of the lubricating oil, although more or less can often be used advantageously. Preferably, the ZDDP is a primary, secondary or mixture ZDDP and present in an amount of from about 0.4 to 1.0 weight percent of the total weight of the lubricating oil.

Preferably, the zinc dialkyl dithiophosphate compounds having the $R^1$ and $R^2$ primary or secondary alkyl groups, in which the $R^1$ and $R^2$ primary or secondary alkyl groups are derived from 1-hexanol, 4-methyl-1-pentanol, or 2-ethyl-1-hexanol, or mixtures thereof are present in an amount of from about 0.1 weight percent to about 0.8 weight percent, or preferably from about 0.1 weight percent to about 0.7 weight percent, or more preferably from about 0.1 weight percent to about 0.6 weight percent, still more preferably from about 0.1 weight percent to about 0.5 weight percent, or even still more preferably from about 0.1 weight percent to about 0.4 weight percent, based on the total weight of the lubricating oil.

Preferably, the zinc dialkyl dithiophosphate compounds having the $R^1$ and $R^2$ primary or secondary alkyl groups, in which the $R^1$ and $R^2$ primary or secondary alkyl groups are derived from 4-methyl-2-pentanol (i-C6), are present in an amount of from about 0.1 weight percent to about 0.8 weight percent, preferably from about 0.1 weight percent to about 0.7 weight percent, more preferably from about 0.1 weight percent to about 0.6 weight percent, still more preferably from about 0.1 weight percent to about 0.5 weight percent, or even still more preferably from about 0.1 weight percent to about 0.4 weight percent, based on the total weight of the lubricating oil.

Preferably, the zinc dialkyl dithiophosphate compounds having the $R^1$ and $R^2$ primary or secondary alkyl groups, in which the $R^1$ and $R^2$ primary or secondary alkyl groups are derived from 2-propanol, 2-butanol, 1-iso-butanol, or n-pentanol, are present in an amount of from about 0.3 weight percent to about 0.8 weight percent, preferably from about 0.3 weight percent to about 0.7 weight percent, more preferably from about 0.3 weight percent to about 0.6 weight percent, and still more preferably from about 0.3 weight percent to about 0.5 weight percent, based on the total weight of the lubricating oil.

In particular, the zinc dialkyl dithiophosphate (ZDDP) antiwear compounds having primary and/or secondary alkyl groups useful in the formulations of this disclosure include a ZDDP having mixed primary 2-ethyl-1-hexanol and secondary 2-propanol alkyl groups present in an amount between about 0.1 weight percent to about 1.0 weight percent, preferably from about 0.2 weight percent to about 1.0 weight percent, more preferably from about 0.2 weight percent to about 0.8 weight percent, still more preferably from about 0.2 weight percent to about 0.7 weight percent, even more preferably from about 0.3 weight percent to about 0.7 weight percent, even still more preferably from about 0.3 weight percent to about 0.6 weight percent, and more preferably still from about 0.4 weight percent to about 0.6 weight percent; a ZDDP having mixed primary 2-ethyl-1-hexanol and secondary 2-butanol alkyl groups present in an amount between about 0.1 weight percent to about 1.0 weight percent, preferably from about 0.2 weight percent to about 1.0 weight percent, more preferably from about 0.2 weight percent to about 0.8 weight percent, still more preferably from about 0.2 weight percent to about 0.7 weight percent, even more preferably from about 0.3 weight percent to about 0.7 weight percent, even still more preferably from about 0.3 weight percent to about 0.6 weight percent, and more preferably still from about 0.4 weight percent to about 0.6 weight percent; and a ZDDP having primary 2-ethyl-1-hexanol or secondary 4-methyl-2-pentanol alkyl groups present in an amount between about 0.1 weight percent to about 1.0 weight percent, preferably from about 0.2 weight percent to about 1.0 weight percent, more preferably from about 0.2 weight percent to about 0.8 weight percent, still more preferably from about 0.2 weight percent to about 0.7 weight percent, even more preferably from about 0.3 weight percent to about 0.7 weight percent, even still more preferably from about 0.3 weight percent to about 0.6 weight percent, and more preferably still from about 0.4 weight percent to about 0.6 weight percent.

Other Additives

The formulated lubricating oil useful in the present disclosure may additionally contain one or more of the other commonly used lubricating oil performance additives including but not limited to antiwear agents, dispersants, other detergents, corrosion inhibitors, rust inhibitors, metal deactivators, extreme pressure additives, anti-seizure agents, wax modifiers, viscosity index improvers, viscosity modifiers, fluid-loss additives, seal compatibility agents, friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973); see also U.S. Pat. No. 7,704,930, the disclosure of which is incorporated herein in its entirety. These additives are commonly delivered with varying amounts of diluent oil, that may range from 5 weight percent to 50 weight percent.

The types and quantities of performance additives used in combination with the instant disclosure in lubricant compositions are not limited by the examples shown herein as illustrations.

Viscosity Index Improvers

Viscosity index improvers (also known as VI improvers, viscosity modifiers, and viscosity improvers) can be included in the lubricant compositions of this disclosure.

Viscosity index improvers provide lubricants with high and low temperature operability. These additives impart shear stability at elevated temperatures and acceptable viscosity at low temperatures.

Suitable viscosity index improvers include high molecular weight hydrocarbons, polyesters and viscosity index improver dispersants that function as both a viscosity index improver and a dispersant. Typical molecular weights of these polymers are between about 10,000 to 1,500,000, more typically about 20,000 to 1,200,000, and even more typically between about 50,000 and 1,000,000.

Examples of suitable viscosity index improvers are linear or star-shaped polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Olefin copolymers, are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5850B"; and from The Lubrizol Corporation under the trade designation "Lubrizol® 7067C". Polyisoprene polymers are commercially available from Infineum International Limited, e.g. under the trade designation "SV200"; diene-styrene copolymers are commercially available from Infineum International Limited, e.g. under the trade designation "SV 260".

The viscosity index improvers may be used in an amount of less than about 2.0 weight percent, preferably less than about 1.0 weight percent, and more preferably less than about 0.5 weight percent, based on the total weight of the formulated oil or lubricating engine oil. Viscosity improvers are typically added as concentrates, in large amounts of diluent oil.

The viscosity index improvers may be used in an amount of from 0.25 to about 2.0 weight percent, preferably 0.15 to about 1.0 weight percent, and more preferably 0.05 to about 0.5 weight percent, based on the total weight of the formulated oil or lubricating engine oil.

Dispersants

During engine operation, oil-insoluble oxidation byproducts are produced. Dispersants help keep these byproducts in solution, thus diminishing their deposition on metal surfaces. Dispersants used in the formulation of the lubricating oil may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,215,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful. The molecular weight of these components may be from about 900 to about 5000 Mn with carbon number ranges from about 50 to about 500, or preferably from about 70 to about 250.

Succinimides are formed by the condensation reaction between hydrocarbyl substituted succinic anhydrides and amines such as EDA, TETA, TEPA, HDPE, and others. Molar ratios can vary depending on the polyamine. For example, the molar ratio of hydrocarbyl substituted succinic anhydride to TEPA can vary from 1:1 to 5:1. Representative examples are shown in U.S. Pat. Nos. 3,087,936; 3,172,892; 3,219,666; 3,272,746; 3,322,670; and 3,652,616, 3,948,800; and Canada Patent No. 1,094,044.

Succinate esters are formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides are formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the hydrocarbyl substituted succinic anhydrides used in the preceding paragraphs will typically range between 800 and 2,500 or more. The above products can be post-reacted with various reagents such as sulfur, oxygen, formaldehyde, carboxylic acids such as oleic acid and cyclic carbonate. The above products can also be post reacted with boron compounds such as boric acid, borate esters or highly borated dispersants, to form borated dispersants generally having from 0.1 to 5 moles of boron per mole of dispersant reaction product. These can be zinc blocked by reacting with zinc oxide or zinc acetate or blocked by cyclic carbonate or other acidic materials. Dispersants used can contain basic nitrogen, non-basic nitrogen, or mixtures of the same.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or $HNR_2$ group-containing reactants.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, or mixtures of borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from 250 to 5000, preferably from about 500 to about 5000, more preferably from about 500 to about 4000, or most preferably from about 1000 to about 3000, or a mixture of such hydrocarbylene groups, often with high terminal vinylic groups. Other preferred dispersants include succinic acid-esters and amides, alkylphenol-polyamine-coupled Mannich adducts, their capped derivatives, PIBSA, and other related components. Such additives may be used in an amount of 0.1 to 20 weight percent, preferably 0.5 to 8 weight percent, or more preferably 0.5 to 4 weight percent. On an active ingredient basis, such additives may be used in an amount of 0.06 to 14 weight percent, preferably 0.3 to 6 weight percent. The hydrocarbon portion of the dispersant atoms can range from C60 to C400, or from C70 to C300, or from C70 to C200. These dispersants may contain both neutral and basic nitrogen, and mixtures of both. Dispersants can be end-capped by borates and/or cyclic carbonates.

As used herein, the dispersant concentrations are given on an "as delivered" basis. Typically, the active dispersant is delivered with a process oil. The "as delivered" dispersant typically contains from about 20 weight percent to about 80 weight percent, or from about 40 weight percent to about 60 weight percent, of active dispersant in the "as delivered" dispersant product.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant disclosure. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants are more fully described in U.S. Pat. No. 8,048,833, herein incorporated by reference in its entirety.

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to 20 carbon atoms, and preferably contains from 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least 6 carbon atoms. Examples of aliphatic groups include hexyl, heptyl, octyl, nonyl, and decyl. Generally, the aliphatic groups will not contain more than 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alphanaphthylamine; phenyl-alphanaphthylamine; and p-octylphenyl-alphanaphthylamine.

Sulfurized alkyl phenols and alkali or alkaline earth metal salts thereof also are useful antioxidants.

Preferred antioxidants include hindered phenols, arylamines. These antioxidants may be used individually by type or in combination with one another. Such additives may be used in an amount of 0.01 to 5 weight percent, preferably 0.01 to 2.5 weight percent, more preferably zero to less than 1.5 weight percent, more preferably 0.05 to less than 2.5 weight percent.

Pour Point Depressants (PPDs)

Conventional pour point depressants (also known as lube oil flow improvers) may be added to the compositions of the present disclosure if desired. These pour point depressant may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Such additives may be used in an amount of about 0.01 to 5 weight percent, preferably about 0.01 to 1.5 weight percent.

Seal Compatibility Agents

Seal compatibility agents help to swell elastomeric seals by causing a chemical reaction in the fluid or physical change in the elastomer. Suitable seal compatibility agents for lubricating oils include organic phosphates, alkoxysulfolanes ($C_{10}$ alcohol, for example), aromatic esters, aromatic hydrocarbons, esters (butylbenzyl phthalate, for example), and polybutenyl succinic anhydride. Such additives may be used in an amount of about 0.01 to 3 weight percent, preferably about 0.01 to 2 weight percent.

Antifoam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 weight percent and often less than 0.1 weight percent.

Inhibitors and Antirust Additives

Antirust additives (or corrosion inhibitors) are additives that protect lubricated metal surfaces against chemical attack by water or other contaminants. A wide variety of these are commercially available.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 weight percent, preferably about 0.01 to 1.5 weight percent.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present disclosure if desired. Friction modifiers that lower the coefficient of friction are particularly advantageous in combination with the base oils and lube compositions of this disclosure. Friction modifiers may include metal-containing compounds or materials as well as ashless compounds or materials, or mixtures thereof. Metal-containing friction modifiers may include metal salts or metal ligand complexes where the metals may include alkali, alkaline earth, or transition group metals. Such metal-containing friction modifiers may also have low-ash characteristics. Transition metals may include Mo, Sb, Sn, Fe, Cu, Zn, Ti, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective such as for example Mo-dithiocarbamates, Mo(DTC), Mo-dithiophosphates, Mo(DTP), Mo-amines, Mo(Am), Mo-alcoholates, Mo-alcohol-amides, etc. See U.S. Pat. Nos. 5,824,627, 6,232,276, 6,153,564, 6,143,701, 6,110,878, 5,837,657, 6,010,987, 5,906,968, 6,734,150, 6,730,638, 6,689,725, 6,569,820; and also WO 99/66013; WO 99/47629; and WO 98/26030.

Ashless friction modifiers may also include lubricant materials that contain effective amounts of polar groups, for example, hydroxyl-containing hydrocarbyl base oils, glycerides, partial glycerides, glyceride derivatives, glycerol mono-oleate, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from 0.01 weight percent to 10-15 weight percent or more, often with a preferred range of 0.1 weight percent to 5 weight percent. Concentrations of molybdenum-containing materials are often described in terms of Mo metal concentration. Advantageous concentrations of Mo may range from 10 ppm to 3000 ppm or more, and often with a preferred range of 20-2000 ppm, and in some instances a more preferred range of 30-1000 ppm. Friction modifiers of all types may be used alone or in mixtures with the materials of this disclosure. Often mixtures of two or more friction modifiers, or mixtures of friction modifier(s) with alternate surface active material(s), are also desirable.

When lubricating oil compositions contain one or more of the additives discussed above, the additive(s) are blended into the composition in an amount sufficient for it to perform its intended function. Typical amounts of such additives useful in the present disclosure are shown in Table 1 below.

It is noted that many of the additives are shipped from the additive manufacturer as a concentrate, containing one or more additives together, with a certain amount of base oil diluents. Accordingly, the weight amounts in the table below, as well as other amounts mentioned herein, are directed to the amount of active ingredient (that is the non-diluent portion of the ingredient). The weight percent (wt %) indicated below is based on the total weight of the lubricating oil composition.

TABLE 1

Typical Amounts of Other Lubricating Oil Components

| Compound | Approximate wt % (Useful) | Approximate wt % (Preferred) |
|---|---|---|
| Dispersant | 0.1-20 | 0.1-8 |
| Detergent | 0.1-20 | 0.1-8 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |
| Anti-foam Agent | 0.001-3 | 0.001-0.15 |
| Viscosity Index Improver (solid polymer basis) | 0.1-2 | 0.1-1 |
| Anti-wear | 0.1-1.2 | 0.2-1 |
| Inhibitor and Antirust | 0.01-5 | 0.01-1.5 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

The following non-limiting examples are provided to illustrate the disclosure.

Examples

Formulations were prepared as described in FIG. 1. All of the ingredients used herein are commercially available. Group I and II base stocks were used in the formulations. In FIG. 1, the total treat rate may not add up to 100% due to rounding.

The detergents used in the formulations were selected from neutral total base number (TBN between 0 and 80 mgKOH/g), a medium overbased (TBN between 80 and 200 mgKOH/g), and a highly overbased or highly carbonated (TBN above 200 mgKOH/g) detergents. The detergents used were a highly carbonated calcium phenate (Detergent 1), a neutral calcium sulfonate (Detergent 2), an alkylphenol, noncarbonated calcium alkylphenate and noncarbonated calcium monosalicylate(carboxylate) mixture (Detergent 3), a carboxylate mixture including a noncarbonated calcium alkylphenate, a noncarbonated calcium monosalicylate, and a carbonated calcium monosalicylate(carboxylate) (Detergent 4), a salicylate mixture including overbased and neutral salicylate (Detergent 5), and a neutral salicylate (Detergent 6).

The zinc dialkyl dithiophosphate (ZDDP) antiwear compounds having primary and/or secondary alkyl groups used in the formulations were a ZDDP having mixed primary 2-ethyl-1-hexanol and secondary 2-propanol alkyl groups (ZDDP 1), a ZDDP having mixed primary 2-ethyl-1-hexanol and secondary 2-butanol alkyl groups (ZDDP 2), and a ZDDP having primary 2-ethyl-1-hexanol or secondary 4-methyl-2-pentanol alkyl groups (ZDDP 3).

Other additives used in the formulations included an antioxidant. The antioxidant used in the formulations was an alkylated diphenyl amine.

Testing was conducted for formulations described in FIG. 1. The testing included deposit measurements of the formulations as measured by Komatsu Hot Tube Test where oil is heated to 285° C. and 300° C. and passed through a glass tube, then rated for deposits from 0 (poor) to 10 (clean), and demulsibility measurements of the formulations as measured by High Shear Demulsibility testing, where oil is mixed with a minor amount of water in a high shear blending environment to generate an emulsion, then centrifuged and rated for emulsion layer, free water, water in oil, oil layer description and water. Total base number (TBN) of the formulations was also determined by ASTM D2896. A ratio of zinc to calcium in the finished oil is also shown in FIG. 1. Komatsu Hot Tube Test at 300° C. was not run on samples that yielded a result of 3.5 or poorer at 285° C.

Results in FIG. 1 show a summary of the unexpected test results for formulations of this disclosure described in FIG. 1. The results show that certain formulations provide very good Komatsu Hot Tube performance even at higher temperatures and lower TBN values and still maintain very good demulsibility, while other formulations do not.

FIG. 1 also shows test results for the demulsibility of the lubricating oils measured by High Shear Demulsibility Test (i.e., emulsion layer, free water, and water in oil). The formulations of this disclosure unexpectedly performed better than other formulations in free water, emulsion, and water in oil.

PCT and EP Clauses:

1. A method for improving deposit control, while maintaining or improving demulsibility performance, in an engine lubricated with a lubricating oil by using as the lubricating oil a formulated oil, said formulated oil having a composition comprising a lubricating oil base stock as a major component; and a detergent mixture comprising a first detergent, and at least one other detergent different from said first detergent, as a minor component; wherein said first detergent and said at least one other detergent are selected from the group consisting of a phenate compound, a carboxylate compound, and mixtures thereof; and wherein the phenate compound, carboxylate compound, and mixtures thereof, and the amount of the phenate compound, carboxylate compound, and mixtures thereof in the lubricating oil, are sufficient for the lubricating oil to exhibit improved deposit control, while demulsibility performance is maintained or improved, as compared to deposit control and demulsibility performance achieved using a lubricating oil containing a minor component other than the phenate compound, carboxylate compound, and mixtures thereof, and in an amount other than the amount of the phenate compound, carboxylate compound, and mixtures thereof in the lubricating oil.

2. The method of clause 1 wherein the lubricating oil base stock comprises a Group I or Group II base oil.

3. The method of clauses 1 and 2 wherein the first detergent comprises an overbased phenate compound, a sulfurized/carbonated calcium phenate compound, and mixtures thereof; and wherein the second detergent comprises a mixture of an alkylphenol, noncarbonated calcium alkylphenate and noncarbonated calcium monosalicylate(carboxylate); a carbonated calcium monosalicylate(carboxylate); and mixtures thereof.

4. The method of clauses 1-3 wherein the detergent mixture comprises a carboxylate compound that is present in an amount of from 2.0 weight percent to 3.0 weight percent, and a phenate compound that is present in an amount of from 0.5 weight percent to 1.5 weight percent, based on the total weight of the lubricating oil.

5. The method of clauses 1-4 wherein the formulated oil further comprises an antiwear additive; wherein the antiwear additive comprises a zinc dialkyl dithiophosphate compound represented by the formula $$Zn[SP(S)(OR^1)(OR^2)]_2$$

wherein $R^1$ and $R^2$ are independently primary or secondary $C_1$ to $C_8$ alkyl groups;

wherein the primary or secondary $C_1$ to $C_8$ alkyl groups of the zinc dialkyl dithiophosphate compound are derived from an alcohol selected from the group consisting of: 2-propanol, 1-butanol, 1-isobutanol, 2-butanol, 1-pentanol, 3-methyl-1-butanol, 2-pentanol, 3-pentanol, 3-methyl-2-butanol, 1-hexanol, 4-methyl-1-pentanol, 4-methyl-2-pentanol, and 2-ethyl-1-hexanol; wherein the zinc dialkyl dithiophosphate compound having the $R^1$ and $R^2$ primary or secondary alkyl groups, is present in an amount of from 0.1 weight percent to 1.2 weight percent, based on the total weight of the lubricating oil; or wherein the zinc dialkyl dithiophosphate compound having the $R^1$ and $R^2$ primary or secondary alkyl groups, in which the $R^1$ and $R^2$ primary or secondary alkyl groups are derived from 2-ethyl-1-hexanol, is present in an amount of from 0.1 weight percent to 0.8 weight percent, based on the total weight of the lubricating oil; or wherein the zinc dialkyl dithiophosphate compound having the $R^1$ and $R^2$ primary or secondary alkyl groups, in which the $R^1$ and $R^2$ primary or secondary alkyl groups are derived from 4-methyl-2-pentanol, is present in an amount of from 0.1 weight percent to 0.8 weight percent, based on the total weight of the lubricating oil; or wherein the zinc dialkyl dithiophosphate compound having the $R^1$ and $R^2$ primary or secondary alkyl groups, in which the $R^1$ and $R^2$ primary or secondary alkyl groups are derived from 2-propanol, 2-butanol, 1-iso-butanol, or n-pentanol, is present in an amount of from 0.3 weight percent to 0.8 weight percent, based on the total weight of the lubricating oil.

6. The method of clauses 1-5 wherein the lubricating oil is a marine lubricating oil.

7. The method of clauses 1-6 wherein, in deposit measurements of the lubricating oil as measured by Komatsu Hot Tube Test, deposit control is improved as compared to deposit control of a lubricating oil containing a minor component other than the phenate compound, carboxylate compound, and mixtures thereof, and in an amount other than the amount of the phenate compound, carboxylate compound, and mixtures thereof in the lubricating oil.

8. A lubricating engine oil having a composition comprising a lubricating oil base stock as a major component; and a detergent mixture comprising a first detergent, and at least one other detergent different from said first detergent, as a minor component; wherein said first detergent and said at least one other detergent are selected from the group consisting of a phenate compound, a carboxylate compound, and mixtures thereof; and wherein the phenate compound, carboxylate compound, and mixtures thereof, and the amount of the phenate compound, carboxylate compound, and mixtures thereof in the lubricating oil, are sufficient for the lubricating oil to exhibit improved deposit control, while demulsibility performance is maintained or improved, as compared to deposit control and demulsibility performance achieved using a lubricating oil containing a minor component other than the phenate compound, carboxylate compound, and mixtures thereof, and in an amount other than the amount of the phenate compound, carboxylate compound, and mixtures thereof in the lubricating oil.

9. The lubricating engine oil of clause 8 wherein the lubricating oil base stock comprises a Group I or Group II base oil.

10. The lubricating engine oil of clauses 8 and 9 wherein the first detergent comprises an overbased phenate compound, a sulfurized/carbonated calcium phenate compound, and mixtures thereof; and wherein the second detergent comprises a mixture of an alkylphenol, noncarbonated calcium alkylphenate and noncarbonated calcium monosalicylate(carboxylate); a carbonated calcium monosalicylate(carboxylate); and mixtures thereof.

11. The lubricating engine oil of clauses 8-10 wherein the detergent mixture comprises a carboxylate compound that is present in an amount of from 2.0 weight percent to 3.0 weight percent, and a phenate compound that is present in an amount of from 0.5 weight percent to 1.5 weight percent, based on the total weight of the lubricating oil.

12. The lubricating engine oil of clauses 8-11 wherein the formulated oil further comprises an antiwear additive; wherein the antiwear additive comprises a zinc dialkyl dithiophosphate compound represented by the formula $$Zn[SP(S)(OR^1)(OR^2)]_2$$

wherein $R^1$ and $R^2$ are independently primary or secondary $C_1$ to $C_8$ alkyl groups;

wherein the primary or secondary $C_1$ to $C_8$ alkyl groups of the zinc dialkyl dithiophosphate compound are derived from an alcohol selected from the group consisting of: 2-propanol, 1-butanol, 1-isobutanol, 2-butanol, 1-pentanol, 3-methyl-1-butanol, 2-pentanol, 3-pentanol, 3-methyl-2-butanol, 1-hexanol, 4-methyl-1-pentanol, 4-methyl-2-pentanol, and 2-ethyl-1-hexanol; wherein the zinc dialkyl dithiophosphate compound having the $R^1$ and $R^2$ primary or secondary alkyl groups, is present in an amount of from 0.1 weight percent to 1.2 weight percent, based on the total weight of the lubricating oil; or wherein the zinc dialkyl dithiophosphate compound having the $R^1$ and $R^2$ primary or secondary alkyl groups, in which the $R^1$ and $R^2$ primary or secondary alkyl groups are derived from 2-ethyl-1-hexanol, is present in an amount of from 0.1 weight percent to 0.8 weight percent, based on the total weight of the lubricating oil; or wherein the zinc dialkyl dithiophosphate compound having the $R^1$ and $R^2$ primary or secondary alkyl groups, in which the $R^1$ and $R^2$ primary or secondary alkyl groups are derived from 4-methyl-2-pentanol, is present in an amount of from 0.1 weight percent to 0.8 weight percent, based on the total weight of the lubricating oil; or wherein the zinc dialkyl dithiophosphate compound having the $R^1$ and $R^2$ primary or secondary alkyl groups, in which the $R^1$ and $R^2$ primary or secondary alkyl groups are derived from 2-propanol, 2-butanol, 1-iso-butanol, or n-pentanol, is present in an amount of from 0.3 weight percent to 0.8 weight percent, based on the total weight of the lubricating oil.

13. The lubricating engine oil of clauses 8-12 wherein the lubricating engine oil further comprises one or more of a viscosity index improver, antioxidant, dispersant, pour point depressant, corrosion inhibitor, metal deactivator, seal compatibility additive, anti-foam agent, inhibitor, anti-rust additive, and friction modifier.

14. The lubricating engine oil of clauses 8-13 wherein, in deposit measurements of the lubricating engine oil as measured by Komatsu Hot Tube Test, deposit control is improved as compared to deposit control of a lubricating engine oil containing a minor component other than the phenate compound, carboxylate compound, and mixtures thereof, and in an amount other than the amount of the phenate compound, carboxylate compound, and mixtures thereof in the lubricating oil.

15. A gear component of a marine engine lubricated with the lubricating engine oil of clauses 8-14.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims

What is claimed is:

1. A method for improving deposit control, while maintaining or improving demulsibility performance, in an engine lubricated with a lubricating oil by using as the lubricating oil a formulated oil, said formulated oil having a composition comprising a lubricating oil base stock as a major component; and a detergent mixture comprising a first detergent comprising an overbased phenate compound at from 1.0 to 1.5 wt. % of the lubricating oil, and at least one other detergent different from said first detergent wherein the at least one other detergent comprises a carbonated calcium monosalicylate (carboxylate) at from 2.0 to 3.0 wt. % of the lubricating oil, and the amount of the detergent mixture is at least 3.5 wt. % in the lubricating oil with the proviso that the lubricating oil does not include a dispersant, wherein the lubricating oil exhibits improved deposit control, while demulsibility performance is maintained or improved, as compared to deposit control and demulsibility performance achieved using a lubricating oil not containing the detergent mixture in the lubricating oil.

2. The method of claim 1 wherein the lubricating oil base stock comprises a Group I or Group fl base oil.

3. The method of claim 1 wherein the at least one other detergent further corn rises an alkylphenol, noncarbonated calcium alkylphenate and noncarbonated calcium monosalicylate (carboxylate) mixture at about 0.5 wt. % of the lubricating oil.

4. The method of claim 1 wherein the formulated oil further comprises an antiwear additive; wherein the antiwear additive comprises a zinc dialkyl dithiophosphate compound represented by the formula $$Zn[SP(S)(OR^1)(OR^2)]_2$$

wherein $R^1$ and $R^2$ are independently primary or secondary $C_1$ to $C_8$ alkyl groups.

5. The method of claim 4 wherein the primary or secondary $C_1$ to $C_8$ alkyl groups of the zinc dialkyl dithiophosphate compound are derived from an alcohol selected from the group consisting of: 2-propanol, 1-butanol, 1-isobutanol, 2-butanol, 1-pentanol, 3-methyl-1-butanol, 2-pentanol, 3-pentanol, 3-methyl-2-butanol, 1-hexanol, 4-methyl-1-pentanol, 4-methyl-2-pentanol, and 2-ethyl-1-hexanol, and mixtures thereof.

6. The method of claim 4 wherein the zinc dialkyl dithiophosphate compound having the $R^1$ and $R^2$ primary or secondary alkyl groups, is present in an amount of from 0.1 weight percent to 1.2 weight percent, based on the total weight of the lubricating oil; or wherein the zinc dialkyl dithiophosphate compound having the $R^1$ and $R^2$ primary or secondary alkyl groups; in which the $R^1$ and $R^2$ primary or secondary alkyl groups are derived from 2-ethyl-1-hexanol, is present in an amount of from 0.1 weight percent to 0.8 weight percent, based on the total weight of the lubricating oil; or wherein the zinc dialkyl dithiophosphate compound having the $R^1$ and $R^2$ primary or secondary alkyl groups, in which the $R^1$ and $R^2$ primary or secondary alkyl groups are derived from 4-methyl-2-pentanol, is present in an amount of from 0.1 weight percent to 0.8 weight percent, based on the total weight of the lubricating oil; or wherein the zinc dialkyl dithiophosphate compound having the $R^1$ and $R^2$ primary or secondary alkyl groups, in which the and $R^2$ primary or secondary alkyl groups are derived from 2-propanol, 2-butanol, 1-iso-butanol, or n-pentanol, is present in an amount of from 0.3 weight percent to 0.8 weight percent, based on the total weight of the lubricating oil.

7. The method of claim 1 wherein the lubricating oil is a marine lubricating oil.

8. The method of claim 1 wherein the lubricating oil further comprises one or more of a viscosity index improver; antioxidant, pour point depressant, corrosion inhibitor, metal deactivator, seal compatibility additive, anti-foam agent, inhibitor, anti-rust additive, and friction modifier.

9. The method of claim 1 wherein, in deposit measurements of the lubricating oil as measured by Komatsu Hot Tube Test, deposit control is improved by at least 1 rating point as compared to deposit control of a lubricating oil not containing the detergent mixture.

10. The method of claim 1 wherein, in demulsibility measurements of the lubricating oil as measured by High Shear Demulsibility Test, the lubricating oil achieves at least 3.8 mL free water; less than 1 mL emulsion, and less than 1 weight percent water in oil.

11. A lubricating engine oil having a composition comprising a lubricating oil base stock as a major component; and a detergent mixture comprising a first detergent comprising an overbased phenate compound at from 1.0 to 1.5 wt. % of the lubricating oil, and at least one other detergent different from said first detergent wherein the at least one other detergent comprises a carbonated calcium monosalicylate (carboxylate) at from 2.0 to 3.0 wt. % of the lubricating oil, and the amount of the detergent mixture is at least 3.5 wt. % in the lubricating oil with the proviso that the lubricating oil does not include a dispersant, wherein the lubricating oil exhibits improved deposit control, while demulsibility performance is maintained or improved, as compared to deposit control and demulsibility performance achieved using a lubricating oil not containing the detergent mixture in the lubricating oil.

12. The lubricating engine oil of claim 11 wherein the lubricating oil base stock comprises a Group I or Group H base oil.

13. The lubricating engine oil of claim 11 wherein the at least one other detergent further comprises an alkylphenol, noncarbonated calcium alkylphenate and noncarbonated calcium monosalicylate (carboxylate) mixture at about 0.5 wt. % of the lubricating oil.

14. The lubricating engine oil of claim 11 wherein the formulated oil further comprises an antiwear additive; wherein the antiwear additive comprises a zinc dialkyl dithiophosphate compound represented by the formula $Zn[SP(S)(OR^1)(OR^2)]_2$ wherein $R^1$ and $R^2$ are independently primary or secondary C1 to C8 alkyl groups.

15. The lubricating engine oil of claim 14 wherein the primary or secondary $C_1$ to $C_8$ alkyl groups of the zinc dialkyl dithiophosphate compound are derived from an alcohol selected from the group consisting of: 2-propanol, 1-butanol, 1-isobutanol, 2-butanol, 1-pentanol, 3-methyl-1-butanol, 2-pentanol, 3-pentanol, 3-methyl-2-butanol, 1-hexanol, 4-methyl-1-pentanol, 4-methyl-2-pentanol, and 2-ethyl-1-hexanol, and mixtures thereof.

16. The lubricating engine oil of claim 14 wherein the zinc dialkyl dithiophosphate compound having the $R^1$ and $R^2$ primary or secondary alkyl groups, is present in an amount of from 0.1 weight percent to 1.2 weight percent, based on the total weight of the lubricating oil; or wherein the zinc dialkyl dithiophosphate compound having the $R^1$ and $R^2$ primary or secondary alkyl groups, in which the $R^1$ and $R^2$ primary or secondary alkyl groups are derived from 2-ethyl-1-hexanol, is present in an amount of from 0.1 weight percent to 0.8 weight percent, based on the total weight of the lubricating engine oil; or wherein the zinc dialkyl dithiophosphate compound having the $R^1$ and $R^2$ primary or secondary alkyl groups, in which the and $R^2$ primary or secondary alkyl groups are derived from 4-methyl-2-pentanol, is present in an amount of from 0.1 weight percent to 0.8 weight percent, based on the total weight of the lubricating engine oil; or wherein the zinc dialkyl dithiophosphate compound having the $R^1$ and $R^2$ primary or secondary alkyl groups, in which the $R^1$ and $R^2$ primary or secondary alkyl groups are derived from 2-propanol, 2-butanol, 1-iso-butanol, or n-pentanol, is present in an amount of from 0.3 weight percent to 0.8 weight percent, based on the total weight of the lubricating engine oil.

17. The lubricating engine oil of claim 11 wherein the lubricating engine oil is a marine lubricating oil.

18. The lubricating engine oil of claim 11 wherein the lubricating engine oil further comprises one or more of a viscosity index improver, antioxidant, pour point depressant, corrosion inhibitor, metal deactivator, seal compatibility additive, anti-foam agent, inhibitor, anti-rust additive, and friction modifier.

19. The lubricating engine oil of claim 11 wherein, in deposit measurements of the lubricating engine oil as measured by Komatsu Hot Tube Test, deposit control is improved as compared to deposit control of a lubricating engine oil not containing the detergent mixture.

20. The lubricating engine oil of claim 11 wherein, in demulsibility measurements of the lubricating oil as measured by High Shear Demulsibility Test, the lubricating oil achieves at least 3.8 mL free water, less than 1 mL emulsion, and less than 1 weight percent water in oil.

21. A piston, bearing, or gear component of a marine engine lubricated with the lubricating engine oil of claim 11.

* * * * *